US012292204B2

(12) United States Patent
Kim et al.

(10) Patent No.: US 12,292,204 B2
(45) Date of Patent: May 6, 2025

(54) AIR CONDITIONER

(71) Applicant: SAMSUNG ELECTRONICS CO., LTD., Suwon-si (KR)

(72) Inventors: Gahyun Kim, Suwon-si (KR); Byungghun Kim, Suwon-si (KR); Yongho Seo, Suwon-si (KR); Wooseog Song, Suwon-si (KR); Mingi Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 243 days.

(21) Appl. No.: 17/981,855

(22) Filed: Nov. 7, 2022

(65) Prior Publication Data

US 2023/0204227 A1 Jun. 29, 2023

Related U.S. Application Data

(63) Continuation of application No. PCT/KR2022/014442, filed on Sep. 27, 2022.

(30) Foreign Application Priority Data

Dec. 23, 2021 (KR) ..... 10-2021-0186074

(51) Int. Cl.
*F24F 1/0033* (2019.01)
*F24F 1/0022* (2019.01)
(Continued)

(52) U.S. Cl.
CPC ..... *F24F 1/0033* (2013.01); *F24F 1/0022* (2013.01); *F24F 1/0047* (2019.02); *F24F 1/0067* (2019.02); *F24F 2221/28* (2013.01)

(58) Field of Classification Search
CPC ..... F24F 1/0014; F24F 1/003; F24F 1/0011; F24F 1/0022; F24F 1/0047; F24F 1/67; F24F 2013/205; F24F 2221/28
See application file for complete search history.

(56) References Cited

U.S. PATENT DOCUMENTS 10,203,121 B2 2/2019 Song et al.
10,386,079 B2 8/2019 Kim et al.
(Continued)

FOREIGN PATENT DOCUMENTS

JP 2002-243194 8/2002
KR 10-2000-0055145 9/2000
(Continued)

OTHER PUBLICATIONS

International Search Report, PCT/ISA/210, issued Jan. 25, 2023, in International Application PCT/KR2022/014442.
(Continued)

*Primary Examiner* — Len Tran
*Assistant Examiner* — Kamran Tavakoldavani
(74) *Attorney, Agent, or Firm* — STAAS & HALSY LLP

(57) ABSTRACT

An air conditioner including an arc shaped discharge port formed in a cylindrical member of a housing; a main fan; an arc shaped heat exchanger between the main fan and an inner peripheral surface of the cylindrical member with respect to a radial direction of the cylindrical member; and an auxiliary fan. A discharge flow path is formed between an outer peripheral end of the heat exchanger and the inner peripheral surface of the cylindrical member. A guide flow path is formed outside the discharge flow path with respect to the radial direction of the cylindrical member. The auxiliary fan is in the discharge flow path and is configured to suck some of the air discharged through the discharge port into the guide flow path. The guide flow path returns the air sucked by the auxiliary fan to the auxiliary fan.

17 Claims, 7 Drawing Sheets

(51) Int. Cl.
*F24F 1/0047* (2019.01)
*F24F 1/0067* (2019.01)

(56) References Cited

U.S. PATENT DOCUMENTS

| | | | | |
|---|---|---|---|---|
| 10,976,061 | B2 | 4/2021 | Kim et al. | |
| 11,047,584 | B2 | 6/2021 | Lee et al. | |
| 11,629,881 | B2 | 4/2023 | Lee et al. | |
| 11,639,812 | B2 | 5/2023 | Lee et al. | |
| 2011/0220322 | A1 | 9/2011 | Asano | |
| 2017/0115028 | A1* | 4/2017 | Lee | B01D 46/523 |
| 2020/0224889 | A1* | 7/2020 | Mochizuki | F24F 1/0047 |

FOREIGN PATENT DOCUMENTS

| | | |
|---|---|---|
| KR | 10-1707618 | 2/2017 |
| KR | 10-2018-0055156 | 5/2018 |
| KR | 10-2018-0072631 | 6/2018 |
| KR | 10-2205943 | 1/2021 |
| KR | 10-2336270 | 12/2021 |
| KR | 10-2508221 | 3/2023 |
| KR | 10-2513469 | 3/2023 |

OTHER PUBLICATIONS

Written Opinion/PCT/ISA/220, issued Jan. 25, 2023, in International Application PCT/KR2022/014442.

* cited by examiner

AIR CONDITIONER

CROSS-REFERENCE TO RELATED APPLICATION(S)

This application is a continuation application, under 35 U.S.C. § 111(a), of international application No. PCT/KR2022/014442, filed on Sep. 27, 2022, which claims priority to Korean Patent Application No. 10-2021-0186074, filed on Dec. 23, 2021, in the Korean Intellectual Property Office, the disclosure of which is incorporated by reference herein in its entirety

BACKGROUND

1. Field

The disclosure relates to an air conditioner configured to control a discharge airflow without a blade structure and a control method thereof.

2. Description of Related Art

An air conditioner is a device that includes a compressor, a condenser, an expansion valve, an evaporator, a main fan, and the like, and controls indoor temperature, humidity, airflow, etc. using a refrigeration cycle. The air conditioner may be classified into a separate type including an indoor unit arranged indoors and an outdoor unit arranged outdoors, and an integral type in which both the indoor unit and the outdoor unit are arranged in one housing.

The indoor unit of the air conditioner includes a heat exchanger performing heat exchange between refrigerant and air, a main fan moving air, and a motor driving the main fan, so as to cool or heat the room.

The indoor unit of the air conditioner may include a discharge airflow control means configured to discharge air, which is cooled or heated by the heat exchanger, in various directions. In general, such a discharge airflow control means is composed of a vertical or horizontal blade arranged at a discharge port, and a driving device configured to rotationally drive the vertical or horizontal blade. That is, the indoor unit of the air conditioner controls a direction of a discharge airflow by adjusting a rotation angle of the blade.

As for the discharge airflow control structure using the blade, an amount of discharged air may be reduced because an airflow is interrupted by the blades, and a flow noise may be increased due to a turbulence generated around the blades. In addition, because a rotating shaft of the blade is provided in a straight line, a shape of the discharge port is also limited to a straight line.

SUMMARY

Aspects of the disclosure will be set forth in part in the description which follows and, in part, will be obvious from the description, or may be learned by practice of the disclosure.

In accordance with an aspect of the disclosure, an air conditioner may include a housing comprising a cylindrical member, and a discharge port having an arc shape and being formed in a lower portion of the cylindrical member; a main fan; a heat exchanger having an arc shape and being between the main fan and an inner peripheral surface of the cylindrical member with respect to a radial direction of the cylindrical member. A discharge flow path may be formed between an outer peripheral end of the heat exchanger and the inner peripheral surface of the cylindrical member to allow air introduced into the housing by the main fan and exchanging heat with the heat exchanger to flow from the heat exchanger to the discharge port to be discharged through the discharge port. A guide flow path may be formed outside the discharge flow path with respect to the radial direction of the cylindrical member. An auxiliary fan may be in the discharge flow path and configured to suck some of the air discharged through the discharge port into the guide flow path. The guide flow path may return the air sucked by the auxiliary fan into the guide flow path to the auxiliary fan to be blown by the auxiliary fan to the discharge flow path, so as to change a direction of airflow discharged from the discharge port.

The guide flow path may include a first end through which the air sucked by the auxiliary fan is sucked into the guide flow path, and a second end through which the air sucked by the auxiliary fan into the guide flow path through the first end is returned to the auxiliary fan. The first end may be outside of the discharge port with respect to the radial direction of the cylindrical member.

The air conditioner may be installable on a ceiling and, when the air conditioner is installed on the ceiling, the second end may be higher than the first end.

The main fan may include a rotating shaft that, when the air conditioner is installed on a ceiling, may extend vertically, The auxiliary fan may include a rotating shaft extending in a direction perpendicular to the rotating shaft of the main fan.

The discharge flow path may be formed so that the air flowing from the heat exchanger to the discharge port flows downward along the discharge flow path from the heat exchanger to the discharge port. The guide flow path may include a first end through which the air sucked by the auxiliary fan is sucked into the guide flow path, and a second end through which the air sucked by the auxiliary fan into the guide flow path through the first end is returned to the auxiliary fan. The guide flow path may be formed so that the air sucked through the first end flows upward.

The housing may further include a flow path forming frame provided to form at least a portion of the discharge flow path and the guide flow path.

The flow path forming frame may include a first wall formed in an annular shape and forming an outer periphery of the guide flow path, and a second wall formed in an annular shape and on an inner side of the first wall with respect to a circumferential direction of the cylindrical member, the second wall forming an inner periphery of the guide flow path and an outer periphery of the discharge flow path.

The auxiliary fan may be on an inner surface of the second wall.

The guide flow path may include a first end provided as a gap formed between a lower portion of the first wall and a lower portion of the second wall, and a second end provided as a hole formed on the second wall to allow the guide flow path to communicate with the auxiliary fan.

The housing may further include a bridge crossing the discharge port in a radial direction of the cylindrical member to prevent air from being discharged from at least a portion of the discharge port, and the discharge port may be partitioned into a first discharge region and a second discharge region by the bridge.

The auxiliary fan may include a first auxiliary fan arranged in the first discharge region and a second auxiliary fan arranged in the second discharge region.

The first discharge region may include a first side end in a circumferential direction of the discharge port, and a second side end on a side opposite to the first side end in the circumferential direction of the discharge port. The first auxiliary fan may be arranged in a distance of 0.3L or more and 0.7L or less from the first side end in the circumferential direction of the discharge port, where L is a distance between the first side end and the second side end in the circumferential direction of the discharge port is L.

The first auxiliary fan may be arranged at a center of the first discharge region with respect to the circumferential direction of the discharge port.

When the air conditioner is installed on a ceiling, the rotating shaft of the auxiliary fan may be arranged in a distance of 0.2H or more and 0.7H or less from an upper end of the housing, where H is a height between the upper end of the housing and a the discharge port in a vertical extending direction of the cylindrical member is H.

A distance of the discharge flow path in the circumferential direction of the cylindrical member may be greater than a distance of the guide flow path in the circumferential direction of the cylindrical member.

The guide flow path and the auxiliary fan may be configured so that the air sucked by the auxiliary fan into the guide flow path is air around the discharge port.

In accordance with another aspect of the disclosure, an air conditioner includes a housing including a cylindrical member, and a discharge port formed in a lower portion of the cylindrical member, the discharge port having an arc shape, a heat exchanger arranged inside the cylindrical member and having an arc shape, a main fan arranged inside the heat exchanger in a radial direction of the heat exchanger, a discharge flow path formed between an outer peripheral end of the heat exchanger and an inner peripheral surface of the cylindrical member, so as to allow air, which is introduced into the housing by the main fan, to exchange heat with the heat exchanger and then to be discharged to the discharge port, an auxiliary fan configured to suck air around the discharge port so as to change a direction of airflow discharged from the discharge port, and a guide flow path provided to guide air sucked by the auxiliary fan. A rotating shaft of the main fan is arranged to extend in a direction corresponding to an extension axis of the cylindrical member, and a rotating shaft of the auxiliary fan is arranged to extend in a direction perpendicular to the rotating shaft of the main fan.

The guide flow path may be formed outside the discharge flow path with respect to the radial direction of the heat exchanger, and the auxiliary fan may be arranged inside the discharge flow path.

The guide flow path may include a first end arranged on an outside of the discharge port with respect to the radial direction of the heat exchanger, the first end through which air sucks, and a second end provided to pass through the discharge flow path and the guide flow path to allow the guide flow path to communicate with the auxiliary fan.

The discharge flow path may be provided to allow air flowing on the discharge flow path to flow downward, and the guide flow path may be provided to allow air flowing on the guide flow path to flow upward.

In accordance with another aspect of the disclosure, an air conditioner includes a housing including a cylindrical member, and a discharge port formed in a lower portion of the cylindrical member, the discharge port having an arc shape, a heat exchanger arranged inside the cylindrical member and having an arc shape, a main fan arranged inside the heat exchanger in a radial direction of the heat exchanger, a discharge flow path formed between an outer peripheral end of the heat exchanger and an inner peripheral surface of the cylindrical member, so as to allow air, which is introduced into the housing by the main fan, to exchange heat with the heat exchanger and then to be discharged to the discharge port, an auxiliary fan configured to suck air around the discharge port so as to change a direction of airflow discharged from the discharge port, a guide flow path provided to guide air sucked by the auxiliary fan, and a flow path forming frame provided to form at least a portion of the discharge flow path and the guide flow path. The flow path forming frame includes a first wall formed in an annular shape and provided to form an outer periphery of the guide flow path, and a second wall formed in an annular shape and arranged on an inner side of the first wall with respect to a circumferential direction of the cylindrical member, the second wall provided to form an inner periphery of the guide flow path and an outer periphery of the discharge flow path. The auxiliary fan is arranged on an inner surface of the second wall.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
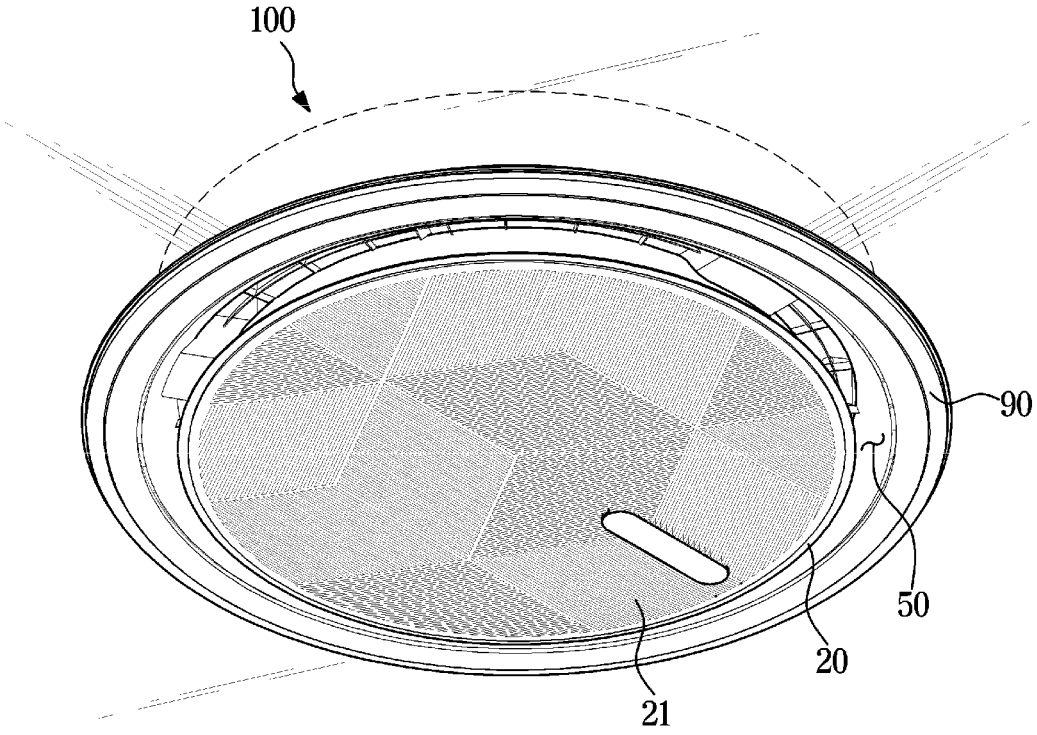
FIG. 1 is a perspective view of an air conditioner according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

It is an aspect of the disclosure to provide an indoor unit of an air conditioner capable of controlling a discharge airflow without a blade structure.

It is another aspect of the disclosure to provide an indoor unit of an air conditioner capable of efficiently controlling a discharge airflow in an airflow discharged from an annular discharge port.

Figure 2:
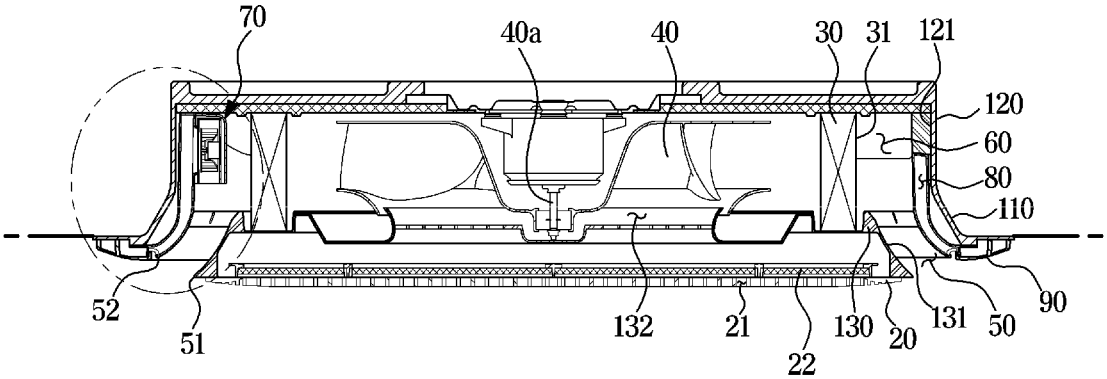
FIG. 2 is a side cross-sectional view of the air conditioner shown in FIG. 1.
Figure 3:
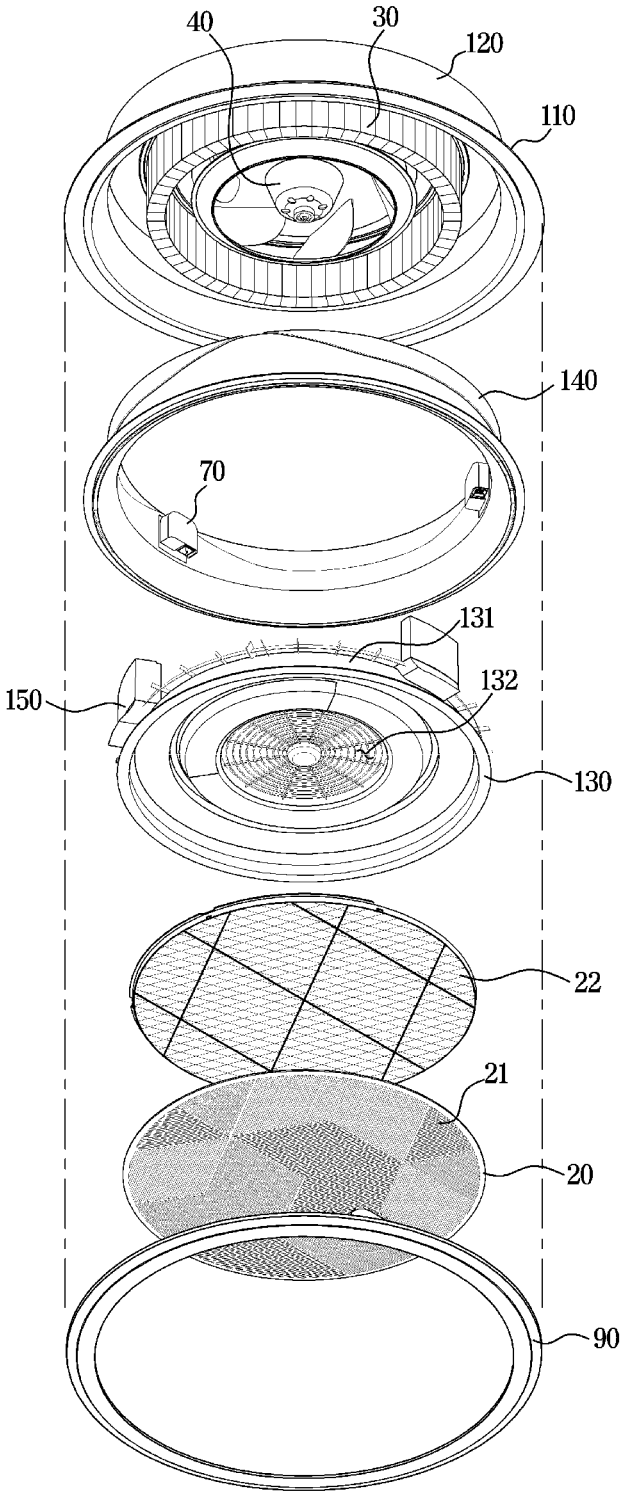
FIG. 3 is an exploded-perspective view of the air conditioner shown in FIG. 1.
Figure 4:
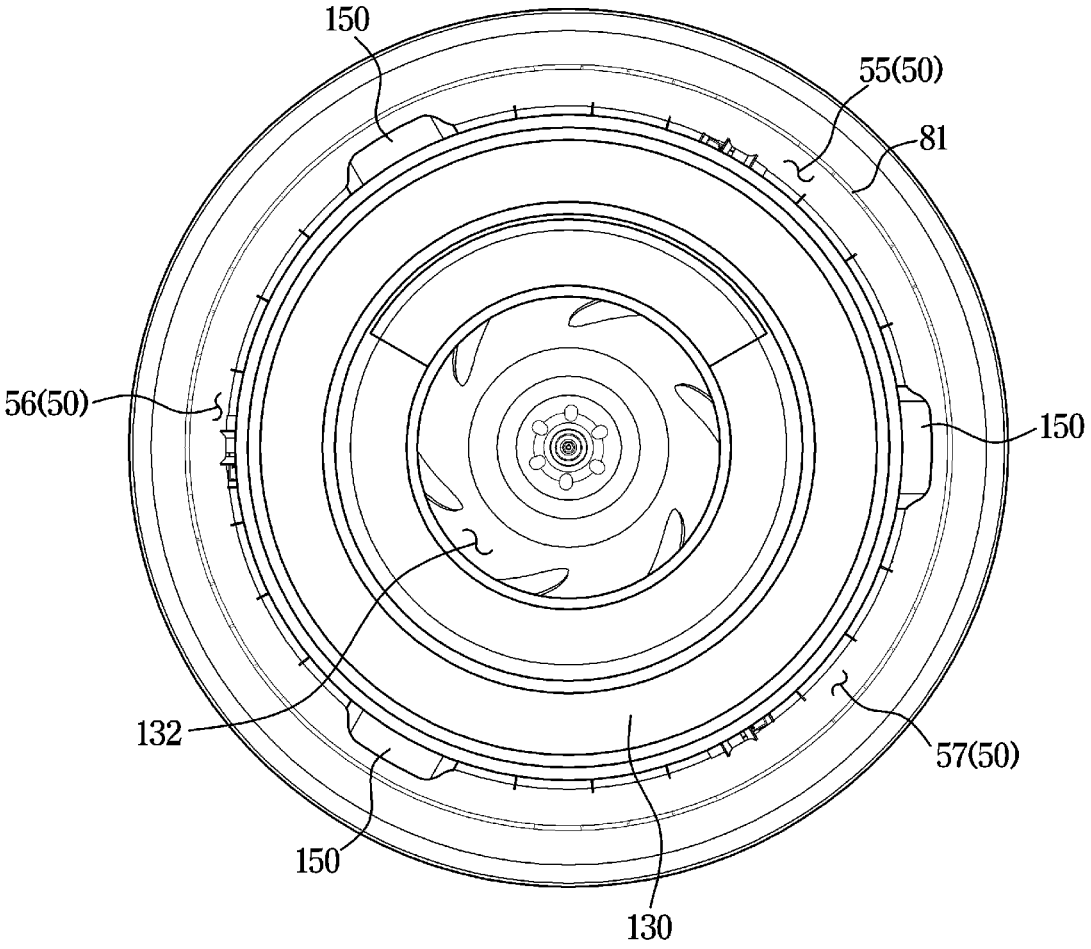
FIG. 4 is a view illustrating a state in which a suction panel is disassembled from the air conditioner shown in FIG. 1.
Figure 5:
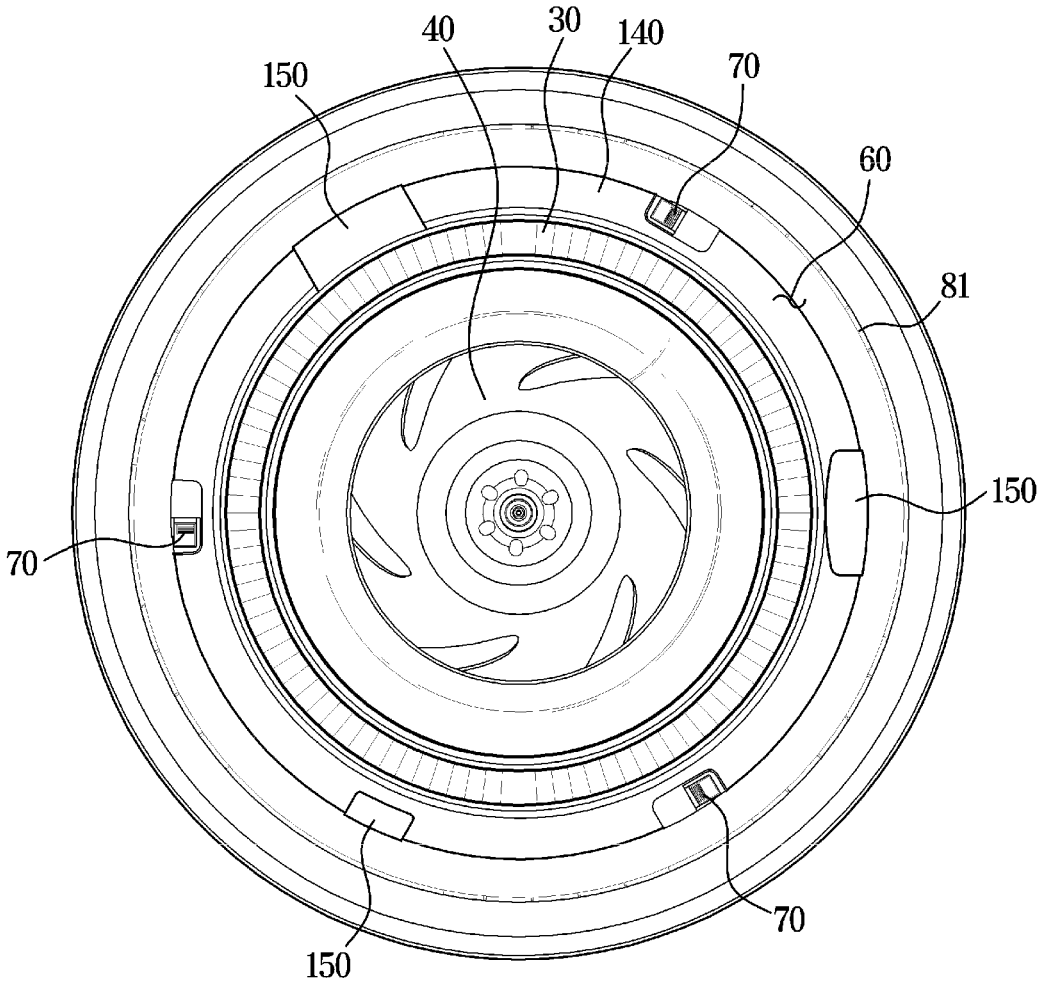
FIG. 5 is a view illustrating a state in which a lower housing is disassembled from the air conditioner shown in FIG. 4.

The disclosure will be described more fully hereinafter with reference to the accompanying drawings FIG. 1 is a perspective view of an air conditioner according to an embodiment of the disclosure, FIG. 2 is a side cross-sectional view of the air conditioner shown in FIG. 1, FIG. 3 is an exploded-perspective view of the air conditioner shown in FIG. 1, FIG. 4 is a view illustrating a state in which a suction panel is disassembled from the air conditioner shown in FIG. 1, and FIG. 5 is a view illustrating a state in which a lower housing is disassembled from the air conditioner shown in FIG. 4.

As illustrated in FIGS. 1 to 3, an air conditioner 1 may be installed on a ceiling. At least a part of the air conditioner 1 may be embedded in the ceiling.

The air conditioner 1 may include a housing 100 including a substantially cylindrical shape, a heat exchanger 30 arranged inside the housing 100, and a main fan 40 configured to move air.

The housing 100 may include an upper housing 110 and a lower housing 130 arranged below the upper housing 110. The upper housing 110 may include a cylindrical member 120 having a cylindrical shape extending in a vertical direction. The cylindrical member 120 is not limited to a circular cylindrical shape, and may be provided in an elliptical cylindrical or polygonal prism shape.

The heat exchanger 30 and the main fan 40 may be arranged inside the upper housing 110.

The heat exchanger 30 may be provided to have an arc shape. It is appropriate that the heat exchanger 30 is provided in an annular shape in which at least a portion is cut out. The heat exchanger 30 may be arranged inside an inner peripheral surface 121 of the cylindrical member 120 with respect to a radial direction of the cylindrical member 120.

The main fan 40 may be arranged inside the heat exchanger 30 in the radial direction of the cylindrical member 120 to allow air, which is introduced into the housing 100 by the main fan 40, to exchange heat with the heat exchanger 30. The main fan 40 that is a general blower fan may also be referred to as a blower fan. However, for the difference from an auxiliary fan 71 of an airflow control device 70 to be described later, it is referred to as the main fan 40.

The housing 100 may include a suction panel 20 provided with a suction port 21 through which air is introduced into the housing 100 by the main fan 40. The suction panel 20 may be detachably coupled to the lower housing 130. It is appropriate that the suction panel 20 is coupled to or separated from the lower housing 130 according to a rotation in a circumferential direction of the cylindrical member 120 with respect to the lower housing 130.

The suction panel 20 may be arranged in a center of the lower housing 130. Air may be introduced into the housing 100 from a lower center of the housing 100 through the suction port 21 formed in the suction panel 20.

The suction panel 20 may include a filter 22 arranged on an upper surface of the suction panel 20 to remove foreign substances in the air flowing into the housing 100. Air passing through the filter 22 may be introduced into the housing 100 through the lower housing 130.

The housing 100 may include a discharge port 50 formed at a lower end of the lower housing 130 and having an arc shape. On the lower end of the lower housing 130, the discharge port 50 may be formed outside an outer peripheral end of the heat exchanger 30 with respect to the radial direction of the cylindrical member 120.

It is appropriate that the discharge port 50 may be provided in a cut-annular shape. An inner periphery 51 of the discharge port 50 may be provided as the lower housing 130, and an outer periphery 52 of the discharge port 50 may be provided as a flow path forming frame 140 to be described later. However, the disclosure is not limited thereto, and the outer periphery 52 of the discharge port 50 may be formed by the upper housing 110. Further, the disclosure is not limited thereto, and both the inner periphery 51 and the outer periphery 52 of the discharge port 50 may be formed by the lower housing 130.

The air conditioner 1 may include a discharge flow path 60 formed between an outer peripheral end 31 of the heat exchanger 30 and the inner peripheral surface 121 of the cylindrical member 120, so as to allow air, which is introduced into the housing 100 by the main fan 40, to exchange heat with the heat exchanger 30 and then to be discharged to the discharge port 50.

The discharge flow path 60 may be a space formed between the outer peripheral end 31 of the heat exchanger 30 and the inner peripheral surface 121 of the cylindrical member 120, and the lower end of the discharge flow path 60 may be formed as the discharge port 50.

Particularly, the discharge flow path 60 may be formed by the outer peripheral end 31 of the heat exchanger 30, the lower housing 130, the inside of the cylindrical member 120, and the flow path forming frame 140 to be described later.

The lower housing 130 may include a curved member 131 guiding the air discharged through the discharge flow path 60. The curved member 131 may be provided to guide an airflow, which is discharged to the discharge port 50 through the discharge flow path 60, toward the discharge port 50.

The lower housing 130 may include a suction flow path 132 guiding the air flowing through the suction port 21. The suction flow path 132 may be arranged inside the discharge flow path 60 with respect to the radial direction of the cylindrical member 120.

The suction flow path 132 may be formed on the center of the lower housing 130. The curved member 131 may be formed outside the suction flow path 132 with respect to the radial direction of the cylindrical member 120.

Air, which is introduced into the housing 100 through the suction port 21, may be heat-exchanged with the heat exchanger 30 through the suction flow path 132 and guided to the curved member 131 along the discharge flow path 60 and then discharged to the discharge port 50.

As will be described later, in the discharge port 50, a Coanda curved member 143 of the flow path forming frame 140 may be formed in a portion facing the curved member 131 of the upper housing 130 with respect to the radial direction of the cylindrical member 120. The curved member 131 and the Coanda curved member 143 may induce the air, which flows through the discharge flow path 60, to flow in close contact with the Coanda curved member 143 (refer to FIG. 6).

The lower housing 130 may include a drain tray provided to collect condensed water generated in the heat exchanger 30. The drain tray may be provided as an independent structure to be arranged on the lower housing 130, or alternatively, the drain tray may be provided as an integral structure with the lower housing 130. That is, the lower housing 130 may be provided as a configuration that forms a part of the housing 100 while collecting condensed water.

According to an embodiment of the disclosure, the lower housing 130 is provided to be arranged inside the upper housing 110 in the radial direction of the cylindrical member 120 while being arranged under the upper housing 110.

However, the disclosure is not limited thereto, and at least a portion of the lower housing 130 may be provided to extend from the lower portion of the upper housing 110 to the outside of the upper housing 110 in the radial direction of the cylindrical member 120. That is, the lower housing 130 may be arranged at the lower end of the upper housing 110.

The air conditioner 1 may include a cover member 90 provided to cover the lower outer peripheral end of the housing 100. The cover member 90 may be provided in an annular shape. However, the disclosure is not limited thereto, and the cover member 90 may be provided in a polygonal shape having a hollow to allow the lower portion of the air conditioner 1 to pass therethrough.

The cover member 90 may be rotated in the circumferential direction of the cylindrical member 120 so as to be detachably coupled to the housing 100. The cover member 90 may be provided to form an exterior of the air conditioner 1.

The air conditioner 1 further includes the airflow control device 70 configured to control an airflow discharged from the discharge port 50.

The airflow control device 70 may suck air around the discharge port 50 to change a pressure, thereby controlling a direction of the discharge airflow. In addition, the airflow control device 70 may control an intake amount of air around the discharge port 50. That is, the airflow control device 70 may control the direction of the discharge airflow by controlling the intake amount of air around the discharge port 50.

The control of the direction of the discharge airflow means controlling an angle of the discharge airflow. While sucking air around the discharge port 50, the airflow control device 70 may suck air from one side of a traveling direction of the discharge airflow.

The airflow control device 70 may include the auxiliary fan 71 configured to suck air and a fan case 72 in which the auxiliary fan 71 is received. The auxiliary fan 71 may be referred to as an airflow control fan, but is referred to as an auxiliary fan 71 for the difference from the main fan 40.

According to the embodiment, a centrifugal fan is used as the auxiliary fan 71, but the disclosure is not limited thereto, and various fans such as an axial fan, a cross-flow fan, and a mixed-flow fan may be used as the auxiliary fan 71 according to design specifications.

The housing 100 includes a guide flow path 80 guiding the air sucked by the auxiliary fan 71. The airflow control device 70 and the guide flow path 80 will be described in detail later.

As illustrated in FIGS. 4 and 5, the housing 100 may include a blocking member 150 extending on the discharge flow path 60 or the discharge port 50 by a predetermined length in the circumferential direction of the discharge port 50. The blocking members 150 are spaced apart from each other by a predetermined distance along the circumferential direction, and it is appropriate that three blocking members are provided. However, the disclosure is not limited thereto, and one or a plurality of blocking members 150 may be provided.

The discharge port 50 is provided in an annular shape such as a closed loop shape to correspond to the discharge flow path 60. Accordingly, in response to discharging air in all directions, a relatively high pressure may be formed around the discharge port 50, and a relatively low pressure may be formed around the suction port 21. Further, because air is discharged from all directions of the discharge port 50 and the air forms an air curtain, air supposed to be sucked through the suction port 21 may not be supplied to the suction port 21. In this case, the air discharged from the discharge port 50 is sucked again through the suction port 21, and the re-sucked air causes dew condensation inside the housing 100 and the loss of the discharged air. Accordingly, a performance that a user can feel is reduced.

Therefore, the blocking member 150 according to an embodiment of the disclosure is provided to cross the discharge port 50 having an annular shape with respect to the radial direction of the cylindrical member 120, so as to block at least a portion of the discharge port 50. Accordingly, the blocking member 150 may allow the discharge port 50 to have a cut-annular shape. The blocking member 150 may also be referred to as a bridge.

That is, the blocking member 150 may divide the discharge port 50 corresponding to a complete annular shape by a predetermined length, and the discharge port 50 may be formed in a partially blocked annular shape.

The blocking member 150 may be arranged on the lower housing 130. Particularly, the blocking member 150 may be arranged to restrict the discharge of at least a portion of the air flowing in a portion in which the discharge port 50 and the discharge flow path 60 are formed.

As described above, the blocking member 150 may be provided as three blocking members 150 to divide the discharge port 50 into three discharge regions 55, 56, and 57. The discharge port 50 may include a first discharge region 55, a second discharge region 56, and a third discharge region 57.

Each of the discharge regions 55, 56, and 57 may be defined as a partial region of the discharge port 50, but each of the discharge regions 55, 56, and 57 may be defined as a single discharge port, respectively. That is, it may be understood that the discharge port 50 includes the first discharge port 55, the second discharge port 56, and the third discharge port 57. However, hereinafter for convenience of description, one discharge port 50 is defined to include three discharge regions 55, 56, and 57.

By the blocking member 150, it is possible to divide the discharge port 50 into the three regions 55, 56, and 57 through which air is discharged, and a region in which the blocking member 150 is arranged and the air is not discharged. That is, each region may be partitioned in the circumferential direction of the cylindrical member 120 by the plurality of blocking members 150 spaced apart from each other in the circumferential direction of the cylindrical member 120.

Because the region, through which air is not discharged, is arranged between the three regions 55, 56 and 57, it is possible to reduce a pressure difference between the low pressure around the suction port 21 and the high pressure around the discharge port 50.

The blocking members 150 is illustrated to be arranged at the same distance from each other, that is, at an angle of 120° (120 degrees), but the disclosure is not limited thereto. Alternatively, the blocking member 150 may be provided as a single piece, or may be provided as two blocking members 150 arranged at an angle of 180° (180 degrees), or may be provided as four blocking members 150 arranged at an angle of 90° (90 degrees).

As described above, by the blocking member 150, the air discharged from the discharge port 50 may be discharged while being dispersed toward the room without being re-sucked into the suction port 21.

Various electric components for driving the air conditioner 1 may be arranged in a region, in which the blocking member 150 is arranged, in the vertical direction. For example, a display (not shown) displaying a state of the air conditioner 1 may be arranged in the region in which the blocking member 150 is arranged.

The airflow control device 70 may be arranged in the first discharge region 55, the second discharge region 56, and the third discharge region 57, respectively. The airflow control device 70 may be provided in a number corresponding to the number of the discharge regions 55, 56, and 57. In an embodiment of the disclosure, three airflow control devices 70 may be provided because the discharge region is partitioned into three regions 55, 56, and 57.

Hereinafter the airflow control device 70 and the guide flow path 80 will be described in detail.

Figure 6:
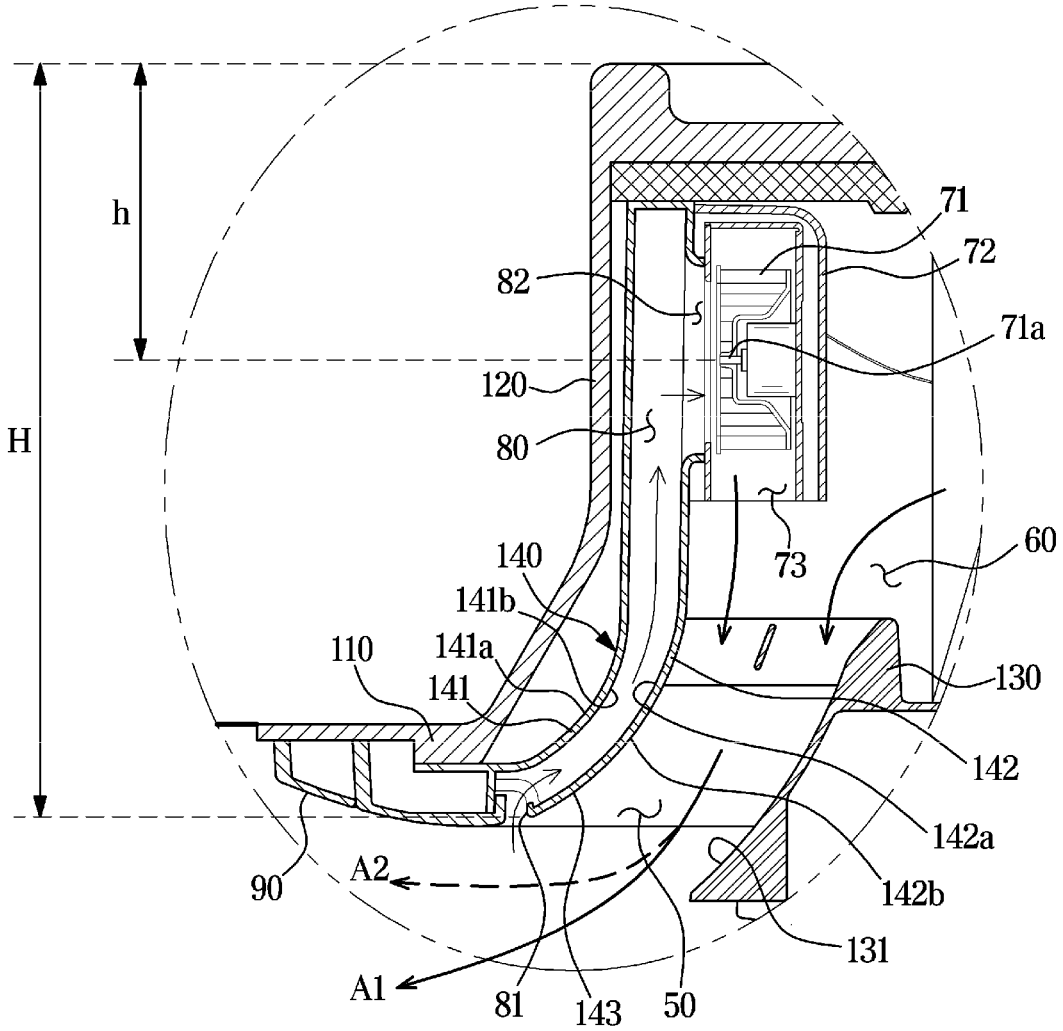
FIG. 6 is an enlarged view of a portion shown in FIG. 2.
Figure 7:
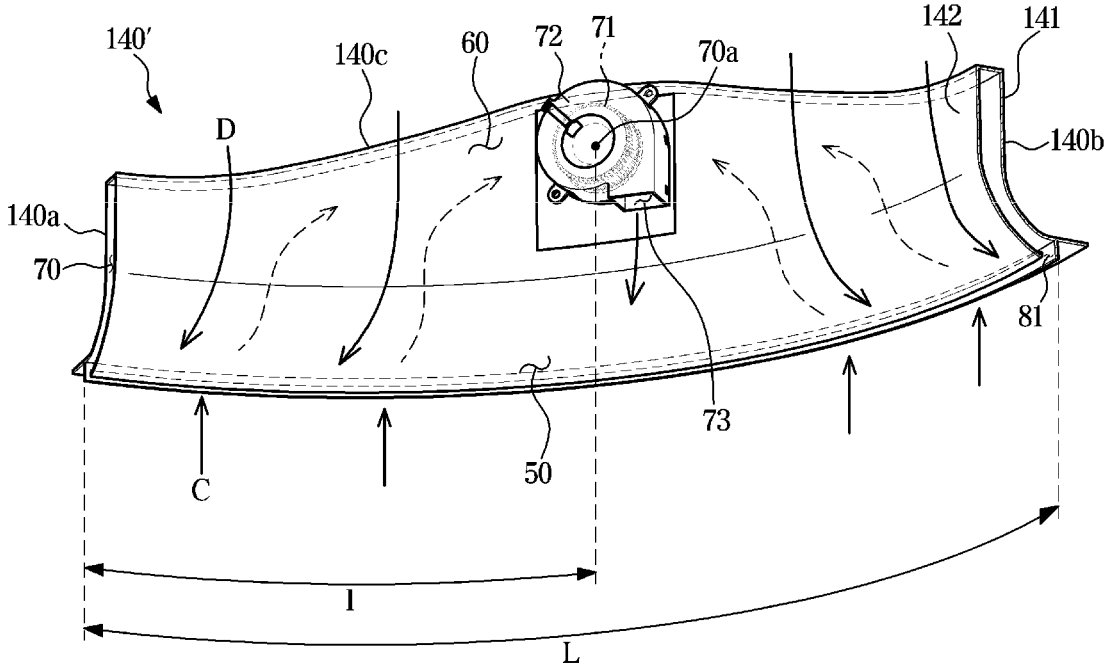
FIG. 7 is a cross-sectional perspective view of a partial configuration of the air conditioner shown in FIG. 1.

FIG. 6 is an enlarged view of a portion shown in FIG. 2, and FIG. 7 is a cross-sectional perspective view of a partial configuration of the air conditioner shown in FIG. 1.

As shown in FIG. 6, the air conditioner 1 may include the guide flow path 80 through which air sucked by the airflow control device 70 is guided.

The guide flow path 80 connects an inlet 81 provided to suck air around the discharge port 50 and an outlet 82 provided to move the sucked air to the auxiliary fan 71. When it is assumed that the suction flow path 132 and the discharge flow path 60 connecting the suction port 21 to the discharge port 50 are referred to as a main flow path, it can be said that the guide flow path 80 is branched from the main flow path.

The inlet 81 that is a portion through which air flows into the guide flow path 80 may be defined as one end of the guide flow path 80. The outlet 82 that is a portion through which air flows out of the guide flow path 80 may be defined as the other end of the guide flow path 80.

The inlet 81 may be provided outside the discharge port 50 with respect to the radial direction of the cylindrical member 120. The inlet 81 may be provided in a substantially annular shape. Particularly, the inlet 81 may be composed of a plurality of slits having an arc shape. The plurality of slits may be arranged to be spaced apart from each other by a predetermined distance along the circumferential direction.

That is, the inlet 81 and the discharge port 50 may each be provided in a substantially annular shape, and each annular shape may be arranged at a predetermined distance in the radial direction of the cylindrical member 120.

As described above, because the inlet 81 is provided in a substantially annular shape, the inlet 81 may easily suck the air discharged in the radial direction from the discharge port 50 having an annular shape, thereby controlling the direction of the discharge airflow formed in the discharge port 50.

It is appropriate that the inlet 81 is formed adjacent to the Coanda curved member 143 of the flow path forming frame 140 to be described later. Accordingly, the discharge airflow, which is bent toward the inlet 81 by the suction force of the auxiliary fan 71, may flow along a surface of the Coanda curved member 143.

The outlet 82 may be arranged on the opposite side of the inlet 81 with respect to the vertical direction and provided to communicate with a fan case 72.

When it is assumed that a direction of airflow discharged from the discharge port 50, in a state in which the airflow control device 70 is not driven, is A1, the airflow control device 70 may suck the air, which flows in A1, through the inlet 81, thereby changing the direction of the discharge airflow to A2 by using the above-mentioned configuration. That is, the airflow control device 70 may control an angle of the discharge airflow of the air conditioner 1 in the vertical direction, to be larger.

With this configuration, the indoor unit of the air conditioner according to the embodiment of the disclosure may control a discharge airflow without a blade structure, in comparison with a conventional structure in which a blade is arranged in a discharge port and a discharge airflow is controlled by a rotation of the blade. Accordingly, an interruption caused by the blade is removed, and thus it is possible to increase an amount of discharge air and to reduce the flow noise.

In addition, the discharge port of the indoor unit of the conventional air conditioner has only straight shape to rotate the blade, but the discharge port of the indoor unit of the air conditioner according to the embodiment of the disclosure may be provided in a circular shape. Accordingly, the housing and heat exchanger may also be provided in a circular shape. Therefore, aesthetics may be improved with a differentiated design, and further, the air may naturally flow due to the circular-shaped blower fan, and the pressure loss may be reduced. As a result, a cooling or heating performance of the air conditioner may be improved.

However, due to the guide flow path 80 being arranged inside the housing 100, a space inside the housing 100 may be increased and thus a size of the housing 100 may be increased. The increase in the size of the housing 100 may cause a difficulty in installing the air conditioner 1, and thus an efficiency may be reduced.

In addition, in a state in which the guide flow path 80 is formed to move air, flowing through the guide flow path 80, toward the circumferential direction of the cylindrical member 120, a resistance may be increased inside the guide flow path 80, thereby reducing the suction power, and accordingly, a performance of airflow control may be reduced. It is possible to increase a capacity of the auxiliary fan 70 so as to prevent the above-mentioned difficulty. However, the increase in the capacity of the auxiliary fan 70 may cause an increase in a volume of the housing 100, a generation of the noise or a reduction in the efficiency of the air conditioner 1.

The air conditioner 1 according to an embodiment of the disclosure is provided such that the auxiliary fan 71 is efficiently arranged so as to ease the above-mentioned difficulty.

In addition, in order to ease the above-mentioned difficulty, the air conditioner 1 according to an embodiment of the disclosure is provided such that air flowing on the guide flow path 80 flows efficiently.

Particularly, the auxiliary fan 71 may be arranged on the discharge flow path 60. In a state in which a flow distance of air inside the guide flow path 80 is long and complicated, a large-volume fan is required. However, the installation of the large-volume fan on the discharge flow path 60 may interrupt the movement of the air inside the discharge flow path 60, which may cause a reduction in the efficiency of the air conditioner 1.

For example, based on the guide flow path 80 being provided to allow air to flow in the circumferential direction of the cylindrical member 120, a flow distance of air flowing to the auxiliary fan 71 through the guide flow path 80 may be increased and a flow cross-section of the guide flow path 80 may be provided to be small in order to secure an inner space of the upper housing 110. Accordingly, the flow of the air flowing inside the guide flow path 80 may be reduced.

As will be described later, the guide flow path 80 of the air conditioner according to an embodiment of the disclosure may be provided to allow the flow distance of the air to be minimized and thus the auxiliary fan 71 may have a minimum capacity. Accordingly, a component arranged on the discharge flow path 60 and provided to receive the auxiliary fan 71 may not restrict the flow of the air inside the discharge flow path 60, and thus it is possible to increase the efficiency of the flow of the air flowing in the discharge flow path 60.

A rotating shaft 40*a* of the main fan 40 may extend in the vertical direction as shown in FIG. 2, but a rotating shaft 71*a* of the auxiliary fan 71 may extend in a direction substantially perpendicular to the direction in which the rotating shaft 40*a* extends as shown in FIG. 6. That is, the rotating shaft 71*a* of the auxiliary fan 71 may extend in a direction corresponding to the radial direction of the cylindrical member 120.

Accordingly, even when the auxiliary fan 71 is arranged inside the discharge flow path 60, it is possible to minimize the restriction of the flow of air flowing in the discharge flow path 60. However, in response to the rotating shaft 71*a* of the auxiliary fan 71, which is centrifugal fan, extending in a direction corresponding to the rotating shaft 40*a* of the main fan 40, an area in which the auxiliary fan 71 restricts the flow of the air on the discharge flow path 60 may be increased.

Further, in order to prevent the auxiliary fan 71 from restricting the flow of the air on the discharge flow path 60 in a state in which the rotating shaft 71*a* of the auxiliary fan 71 extends in a direction corresponding to the rotating shaft 40*a* of the main fan 40, the auxiliary fan 71 may not be arranged on the discharge flow path 60 and the size of the housing 100 may be increased to maintain the flow area of the discharge flow path 60.

In order that the auxiliary fan 71 is not arranged on the discharge flow path 60, the housing 100 may be formed such that the auxiliary fan 71 is arranged in a region, in which the discharge flow path is not formed, in the vertical direction of the cylindrical member 120. However, in this case, the volume of the housing 100 may be increased in the vertical direction.

In addition, in order to maintain the flow area of the discharge flow path 60, the volume of the housing 100 may be increased in the circumferential direction of the cylindrical member 120, which may cause a reduction in the efficiency of the air conditioner 1.

However, as described above, based on the rotating shaft 71*a* of the auxiliary fan 71 being arranged in a direction substantially perpendicular to the direction in which the rotating shaft 40*a* of the main fan 40 extends, it is possible to minimize the restriction in the flow of the air on the discharge flow path 60 although the auxiliary fan 71 is arranged inside the discharge flow path 60.

The air in the discharge flow path 60 flows from the upper side to the lower side in the housing 100, and the rotating shaft 71*a* of the auxiliary fan 71 is arranged in a direction substantially perpendicular to the direction in which the rotating shaft 40*a* of the main fan 40 extends. Accordingly, an area of a region, in which the auxiliary fan 71 is arranged, in the vertical direction of the housing 100 may be minimized and thus the restriction in the flow area on the discharge flow path 60 may be minimized.

Because the auxiliary fan 71 is arranged inside the discharge flow path 60, an additional housing provided to receive the auxiliary fan 71 may not be required and thus the volume of the entire housing 100 may be reduced.

The inlet 81 of the guide flow path 80 may be arranged to be lower than the outlet 82. As described above, a portion of the air discharged from the discharge port 50 by the auxiliary fan 71 may flow into the guide flow path 80 through the inlet 81 and then flow to the auxiliary fan 71 along the guide flow path 80 through the outlet 82.

As the outlet 82 is arranged to be higher than the inlet 81, the air flowing through the guide flow path 80 may flow from the lower side to the upper side. The air flowing inside the guide flow path 80 may partially flow in the circumferential direction of the cylindrical member 120 as well as flowing to the upper side. However, a main direction of the air flowing on the guide flow path 80 may be the upper side according to a position of the outlet 82.

In a state in which the guide flow path 80 is provided to allow the main direction of the air introduced into the inlet 81 to be the circumferential direction of the cylindrical member 120, a flow length inside the guide flow path 80 may be increased and an interference with the discharge flow path 60 may occur. However, the guide flow path 80 may be provided to allow the air, which is introduced into the inlet 81, to move upward, and thus it is possible to minimize a main travel distance of the guide flow path 80 and to minimize the interference with the discharge flow path 60.

That is, in a state in which the flow direction of the air in the guide flow path 80 is a substantially horizontal direction of the housing 100, such as the circumferential direction or the radial direction of the cylindrical member 120, instead of the vertical direction of the housing 100 corresponding to a direction from the lower side to the upper side, the flow of air on the discharge flow path 60 may be restricted by the guide flow path 80 inside the housing 100 and thus the discharge efficiency may be reduced. In addition, in response to an increase in the area of the discharge flow path 60 to compensate for an area that is limited by the guide flow path 80, a total area of the housing 100 may be increased and the efficiency of the air conditioner 1 may be reduced.

Particularly, because the housing 100 is provided in a cylindrical shape including the cylindrical member 120, the discharge flow path 60 may be formed to extend in the vertical of the housing 100 to have a substantially annular shape inside the housing 100. In this case, based on the guide flow path 80 being formed in the substantially horizontal direction of the housing 100 such as the circumferential direction or the radial direction of the cylindrical member 120, the guide flow path 80 may limit at least a portion of the discharge flow path 60 and thus the airflow on the discharge flow path 60 may be limited.

However, in the air conditioner 1 according to an embodiment of the disclosure, the guide flow path 80 may be formed to allow the airflow in the guide flow path 80 to be the direction from the lower side to the upper side of the housing 100, and the auxiliary fan 71 may be arranged inside the discharge flow path 60 to minimize the restriction on the flow of air on the discharge flow path 60, thereby minimizing the restriction on the flow of air on the discharge flow path 60.

Particularly, even when a depth of an area through which air flows in the radial direction of the cylindrical member 120 is formed to be small (a distance between a first wall 141 and a second wall 142 to be described later), a suction area may be increased because the guide flow path 80 is formed along the circumferential direction of the cylindrical member 120. Accordingly, when the air is introduced into the guide flow path 80, it is possible to reduce the resistance and to maintain the suction performance of the auxiliary fan 71 because the suction area is large in spite of the small width of the guide flow path 80.

Therefore, while forming the small depth of the area, through which the air flows, in the radial direction of the cylindrical member 120 and reducing the total volume of the housing 100, it is possible to maintain the flow area of the discharge flow path 60 at a predetermined level.

As described above, the air flowing inside the discharge flow path 60 may flow from the upper side to the lower inside the housing 100, but the air flowing inside the guide flow path 80 may flow from the lower side to the upper side inside the housing 100.

In order to guide the airflow in the guide flow path 80 and to allow the rotating shaft 71*a* of the auxiliary fan 71 to be arranged in a direction substantially perpendicular to a direction in which the rotating shaft 40*a* of the main fan 40 extends, and to position the auxiliary fan 71 to the inside of the discharge flow path 60, the housing 100 may include the flow path forming frame 140 forming at least portion of the discharge flow path and the guide flow path.

The flow path forming frame 140 may be arranged inside the cylindrical member 120 in the radial direction of the cylindrical member 120. The flow path forming frame 140 may be provided in a substantially annular shape. The flow path forming frame 140 may be arranged outside the lower housing 130 with respect to the radial direction of the cylindrical member 120.

The flow path forming frame 140 may include the first wall 141 forming an outer periphery of the guide flow path 80, and the second wall 142 arranged on an inner side of the first wall 141 with respect to the circumferential direction of the cylindrical member 120 and forming an inner periphery of the guide flow path 80 and forming an outer periphery of the discharge flow path 60.

The first wall 141 and the second wall 142 may be provided in an annular shape, respectively, and may be provided to be spaced apart from each other in the radial direction. The guide flow path 80 may be formed as a space formed between the first wall 141 and the second wall 142.

An outer peripheral surface 141*a* of the first wall 141 may be provided to face the inner peripheral surface 121 of the cylindrical member 120, and an inner peripheral surface 141*b* of the first wall 141 may be provided to face an outer peripheral surface 142*a* of the second wall 142. The guide flow path 80 may be formed between the inner peripheral surface 141*b* of the first wall 141 and the outer peripheral surface 142*a* of the second wall 142. The inner peripheral surface 142*b* of the second wall 142 may form the outer periphery of the discharge flow path 60.

The inlet 81 may be formed between a lower end of the first wall 141 and a lower end of the second wall 142.

The Coanda curved member 143 may be arranged on the inner peripheral surface 142*b* of the second wall 142. Particularly, the Coanda curved member 143 may be arranged adjacent to the lower end of the inner peripheral surface 142*b* of the second wall 142, and accordingly, the air flowing along the Coanda curved member 143 may easily flow into the inlet 81.

As described above, even when the distance between the first wall 141 and the second wall 142 is small, the suction area of the air sucked through the inlet 81 may be increased because the inlet 81 is formed to have an annular shape along the circumferential direction of the cylindrical member 120. Accordingly, in response to the air flowing into the inlet 81, the suction area may be formed to be large in spite of the small width of the inside of the guide flow path 80 formed between the first wall 141 and the second wall 142.

The distance between the first wall 141 and the second wall 142 may be formed to be small. Accordingly, the depth of the area through which air flows in the radial direction of the cylindrical member 120 may be formed to be small in the guide flow path 80, and a volume of a shape of the flow path forming frame 140 may be reduced.

Accordingly, the flow path forming frame 140 may be easily arranged inside the cylindrical member 120, and an inner area except for the flow path forming frame 140 may be maintained inside the cylindrical member 120. Accordingly, the flow area of the discharge flow path 60 may be secured and the efficiency of the air conditioner 1 may be maintained.

The airflow control device 70 may be arranged on the inner peripheral surface 142*b* of the second wall 142. Accordingly, the outlet 82 may be formed with a hole on the second wall 142.

The fan case 72 may be attached to the inner peripheral surface 142*b* of the second wall 142. The fan case 72 may be arranged to correspond to a portion in which the outlet 82 is formed. Accordingly, the air discharged from the guide flow path 80 through the outlet 82 may be introduced into the auxiliary fan 71.

The airflow control device 70 may include a fan case outlet 73 provided to allow air, which flows to the fan case 72 by the auxiliary fan 71, to be discharged to the outside of the fan case 72.

The fan case outlet 73 may be open downward, which is to prevent the airflow on the discharge flow path 60 from being interfered with the air discharged from the fan case 72 because the airflow on the discharge flow path 60 is directed from the upper side to the lower side as described above.

That is, as the flow of air discharged from the auxiliary fan 71 and the flow of air flowing through the main fan 40 are formed in the substantially same direction, a flow rate inside the discharge flow path 60 may be increased, thereby increasing the discharge efficiency.

In addition, a flow rate of the air flowing through the main fan 40 may be higher, and accordingly, a negative pressure may be formed on the discharge flow path 60 in comparison with the fan case 72, and the air discharged from the fan case 72 may flow into the discharge flow path 60 without a large resistance. Accordingly, the discharge efficiency may be increased.

By the flow path forming frame 140, the main direction of the air flowing on the guide flow path 80 may be formed upward, and the auxiliary fan 71 may be arranged such that the rotating shaft 71*a* of the auxiliary fan 71 is in the radial direction of the cylindrical member 120. By the flow path forming frame 140, it is possible to minimize the flow length of the airflow of the guide flow path 80 while minimizing the collision of the air flowing inside the guide flow path 80 and the discharge flow path 60. Accordingly, it is possible to minimize the capacity of the auxiliary fan 71, and thus the auxiliary fan 71 may be arranged inside the discharge flow path 60.

The flow path forming frame 140 according to an embodiment is described as a component separated from the upper housing 110 and the lower housing 130, but the disclosure is not limited thereto. Alternatively, the flow path forming frame 140 may be integrally formed with the upper housing 110 and thus provided as a part of the upper housing 110.

Alternatively, the flow path forming frame 140 may be integrally formed with the lower housing 130 and thus provided as a part of the lower housing 130.

Alternatively, a part of the flow path forming frame 140 may be formed as a part of the upper housing 110, and another part of the flow path forming frame 140 may be formed as a part of the lower housing 130. For example, an upper portion of the guide flow path 80 may be formed by the upper housing 110, and a lower portion of the guide flow path 80 may be formed by the lower housing 130.

When it is assumed that a height between the upper end of the housing 100 and the discharge port 50 in the vertical extending direction of the cylindrical member 120 is H, and it is assumed that a height between the rotating shaft 71*a* of the auxiliary fan 71 and the housing 100 is h, it is appropriate that h is a distance of 0.2H or more and 0.7H or less.

In response to h being greater than 0.7H, the suction power of the auxiliary fan 71 may be increased, and the amount of air introduced into the inlet 81 may be increased, thereby reducing the discharge performance of the air conditioner 1.

In response to h being less than 0.2H, the flow distance of the air inside the guide flow path 80 may be increased, thereby reducing the efficiency of the auxiliary fan 71.

A distance of the discharge flow path 60 in the circumferential direction of the cylindrical member 120 may be greater than a distance of the guide flow path 80 in the circumferential direction of the cylindrical member 120. This is because the discharge efficiency of the air conditioner 1 is lowered in response to the distance of the guide flow path 80 being greater than the distance of the discharge flow path 60.

When it is assumed that a part of the flow path forming frame 140 arranged on the first discharge region 55 is a first member 140', as shown in FIG. 7, the first member 140' in the circumferential direction of the discharge port 50 may include a first side end 140*a* and a second side end 140*b* arranged on the opposite side of the first side end 140*a* in the circumferential direction of the discharge port 50. The first and second side ends 140*a* and 140*b* may be defined as portions which are adjacent to the blocking member 150 arranged at both ends of the first member 140'.

In this case, when it is assumed that a distance between the first side end 140*a* and the second side end 140*b* in the circumferential direction of the discharge port 50 is L, and it is assumed that a distance between the rotating shaft 71*a* of the auxiliary fan 71 arranged on the first member 140' and the first side end 140*a* in the circumferential direction of the discharge port 50 is I, I may be provided as a distance of 0.3L or more and 0.7L or less. It is appropriate that I is provided as a distance of 0.5L and arranged at a center of the first member 140'.

A portion C of the discharge air D guided by the first member 140' may be introduced into the guide flow path 80 through the inlet 81 formed in a length corresponding to a length of the first member 140' in the circumferential direction of the discharge port 50.

In this case, based on the auxiliary fan 71 being arranged to be inclined toward the first side end 140*a* or the second side end 140*b*, a flow rate of the air C introduced from a portion adjacent to the side ends 140*a* may be different from a flow rate of the air C introduced from a portion adjacent to the side ends 140*b*, and thus interference may occur between the air flows, thereby reducing the flow efficiency.

Therefore, I may be provided as a distance of 0.3L or more and 0.7L or less, and accordingly, the air introduced into the inlet 81 on the first member 140' may flow in the guide flow path 80 with a substantially constant flow rate.

As is apparent from the above description, by sucking air around a discharge port, an indoor unit of an air conditioner may control a discharge airflow without a blade.

Further, an indoor unit of an air conditioner may control a discharge airflow without a blade, thereby reducing a reduction in a discharge amount caused by an obstruction by the blade.

Further, an indoor unit of an air conditioner may control a discharge airflow without a blade, thereby reducing a flow noise.

Further, an indoor unit of an air conditioner may have various shapes, such as a circular shape and a curved shape, instead of a conventional straight shape.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing comprising a cylindrical member, and a discharge port having an arc shape and being formed in a lower portion of the cylindrical member;

a main fan;

a heat exchanger having an arc shape and being between the main fan and an inner peripheral surface of the cylindrical member with respect to a radial direction of the cylindrical member, wherein a discharge flow path is formed inside the housing between an outer peripheral end of the heat exchanger and the inner peripheral surface of the cylindrical member to allow air introduced into the housing by the main fan and exchanging heat with the heat exchanger to flow from the heat exchanger to the discharge port to be discharged through the discharge port, and a guide flow path is formed outside the discharge flow path with respect to the radial direction of the cylindrical member; and an auxiliary fan in the discharge flow path and configured to suck some of the air discharged through the discharge port into the guide flow path, wherein the guide flow path returns the air sucked by the auxiliary fan into the guide flow path to the auxiliary fan to be blown by the auxiliary fan to the discharge flow path, so as to change a direction of airflow discharged from the discharge port.

2. The air conditioner of claim 1, wherein the guide flow path comprises a first end through which the air sucked by the auxiliary fan is sucked into the guide flow path, and a second end through which the air sucked by the auxiliary fan into the guide flow path through the first end is returned to the discharge flow path, and the first end is outside of the discharge port with respect to the radial direction of the cylindrical member.

3. The air conditioner of claim 2, wherein the second end is higher than the first end.

4. The air conditioner of claim 1, wherein the main fan includes a rotating shaft extends vertically; and the auxiliary fan includes a rotating shaft extending in a direction perpendicular to the rotating shaft of the main fan.

5. The air conditioner of claim 1, wherein the discharge flow path is formed so that the air flowing from the heat exchanger to the discharge port flows downward along the discharge flow path from the heat exchanger to the discharge port, the guide flow path comprises a first end through which the air sucked by the auxiliary fan is sucked into the guide flow path, and a second end through which the air sucked by the auxiliary fan into the guide flow path through the first end is returned to the discharge flow path, and the guide flow path is formed so that the air sucked through the first end flows upward to the second end.

6. The air conditioner of claim 1, wherein the housing further comprises a flow path forming frame provided to form at least a portion of the discharge flow path and the guide flow path.

7. The air conditioner of claim 6, wherein the flow path forming frame comprises:

a first wall formed in an annular shape and forming an outer periphery of the guide flow path, and a second wall formed in an annular shape and on an inner side of the first wall with respect to a circumferential direction of the cylindrical member, the second wall forming an inner periphery of the guide flow path and an outer periphery of the discharge flow path.

8. The air conditioner of claim 7, wherein the auxiliary fan is on an inner surface of the second wall.

9. The air conditioner of claim 8, wherein the guide flow path comprises:

a first end provided as a gap formed between a lower portion of the first wall and a lower portion of the second wall, and a second end provided as a hole formed on the second wall to allow the guide flow path to communicate with the auxiliary fan.

10. The air conditioner of claim 1, wherein the housing further comprises a bridge crossing the discharge port in a radial direction of the cylindrical member to prevent air from being discharged from at least a portion of the discharge port, and the discharge port is partitioned into a first discharge region and a second discharge region by the bridge.

11. The air conditioner of claim 10, wherein the auxiliary fan comprises a first auxiliary fan arranged in the first discharge region and a second auxiliary fan arranged in the second discharge region.

12. The air conditioner of claim 11, wherein the first discharge region comprises a first side end in a circumferential direction of the discharge port, and a second side end on a side opposite to the first side end in the circumferential direction of the discharge port, and the first auxiliary fan is arranged in a distance of 0.3L or more and 0.7L or less from the first side end in the circumferential direction of the discharge port, where L is a distance between the first side end and the second side end in the circumferential direction of the discharge port.

13. The air conditioner of claim 11, wherein the first auxiliary fan is at a center of the first discharge region with respect to a circumferential direction of the discharge port.

14. The air conditioner of claim 4, wherein the rotating shaft of the auxiliary fan is at a distance of 0.2H or more and 0.7H or less from an upper end of the housing, where H is a height between the upper end of the housing and the discharge port in a vertical extending direction of the cylindrical member.

15. The air conditioner of claim 1, wherein a distance of the discharge flow path in a circumferential direction of the cylindrical member is greater than a distance of the guide flow path in the circumferential direction of the cylindrical member.

16. The air conditioner of claim 1, wherein the guide flow path and the auxiliary fan are configured so that the air sucked by the auxiliary fan into the guide flow path is air around the discharge port.

17. The air conditioner of claim 1, wherein the air conditioner is installable on a ceiling, the main fan includes a rotating shaft that, when the air conditioner is installed on the ceiling, longitudinally extends in a vertical direction, and the auxiliary fan includes a rotating shaft that, when the air conditioner is installed on the ceiling, longitudinally extends in a direction perpendicular to the vertical direction so that the air sucked by the auxiliary fan into the guide flow path flows downward from the auxiliary fan to the discharge flow path.

* * * * *